United States Patent [19]

Barnett

[11] Patent Number: 4,724,684

[45] Date of Patent: Feb. 16, 1988

[54] EARRINGS

[76] Inventor: Barbara J. Barnett, P.O. Box 1070, Laguna Beach, Calif. 92652

[21] Appl. No.: 904,794

[22] Filed: Sep. 5, 1986

Related U.S. Application Data

[63] Continuation of Ser. No. 743,281, Jun. 11, 1985, abandoned, which is a continuation of Ser. No. 512,168, Jul. 8, 1983, abandoned.

[51] Int. Cl.[4] ..... A44C 7/00

[52] U.S. Cl. ..... 63/14.1; D11/42; 63/14.8

[58] Field of Search ..... 63/14 R, 14 A, 14 G, 63/14 B, 12, 13; D11/42, 43, 40, 45, 75, 76, 78

[56] References Cited

U.S. PATENT DOCUMENTS

| | | | |
|---|---|---|---|
| 20,480 | 6/1858 | Carpenter | 63/14 A |
| D. 155,511 | 10/1949 | Janousek | D11/42 |
| D. 189,793 | 2/1961 | Howard | 63/14 R |
| 2,410,914 | 11/1946 | Williams | 63/14 A |
| 2,525,195 | 10/1950 | Austrin | 63/14 A |
| 2,610,486 | 9/1952 | McCann | 63/14 A |
| 3,828,577 | 8/1974 | Haynes | 63/2 |

FOREIGN PATENT DOCUMENTS

| | | | |
|---|---|---|---|
| 205032 | 12/1955 | Australia | 63/14 G |
| 947,523 | 8/1956 | Fed. Rep. of Germany | 63/14 A |
| 956179 | 1/1957 | Fed. Rep. of Germany | 63/14 G |
| 2125973 | 12/1972 | Fed. Rep. of Germany | 63/14 R |
| 433886 | 8/1935 | United Kingdom | 63/14 A |

*Primary Examiner*—Richard J. Johnson

*Attorney, Agent, or Firm*—Lyon & Lyon

[57] ABSTRACT

An earring designed to be worn on the cartilage of the pinna of an ear and give the appearance of a pierced earring.

25 Claims, 6 Drawing Figures

EARRINGS

This is a continuation of co-pending application Ser. No. 743,281 filed on June 11, 1985, now abandoned, which is a continuation, of application Ser. No. 512,168, filed July 8, 1983, now abandoned.

BACKGROUND OF THE INVENTION

The field of the present invention relates generally to earrings.

An earring is an ornament of jewelry which is worn in the ear. It is well known that an earring may be attached to the lobe of an ear by a clamp or a screw. The clamp or screw must be tightened against the earlobe which is composed of tough areolar and adipose tissue which is not very firm. Therefore, the clasp must be large enough to support the earring and the clamp or screw must be tightly affixed against the earlobe. However, such devices are often uncomfortable when the clasp or screw is too tight. On the other hand, when the clasp or screw is not tight enough, the earring will become detached from the ear and lost, and even a tightly affixed earring may become detached from the ear and lost if the person wearing such an earring is engaged in an act of physical activity. Further, the bulkiness of the clasp detracts from a dainty, cosmetic appearance.

It is also known that an earring may be held in an earlobe by a pin placed through a hole pierced in an earlobe. While such an earring has a more cosmetically acceptable appearance and may be made smaller due to the lack of a clasp, a person cannot wear such an earring until an earlobe has been surgically pierced. Since some people find such a surgical procedure too psychologically unattractive, not everyone can wear a pierced earring. Once one has decided to have an earlobe pierced, there is associated therewith a certain degree of pain and the resulting hole must be kept clean to avoid infection or a closing of the hole. Finally, although a pierced earring is more secure than an earring attached to the lobe of an ear by a clamp or a screw, a pierced earring suffers from the very real disadvantage that should the earring become caught, or should someone pull on the earring, the earlobe of the wearer will be painfully torn since the earring will not detach from the hole as would a clamp or screw earring.

Accordingly, there exists a need for an attractive, safe earring which may be easily affixed to an ear without the necessity of having a pierced ear. Such an earring must also be capable of being comfortably and tightly affixed to the ear with a minimum of excess, unsightly bulk.

SUMMARY OF THE INVENTION

In the present invention, an earring is provided to be attached to the cartilage of an ear.

When an earring in accordance with the present invention is affixed to the cartilage of the pinna of an ear, the earring is comfortably and advantageously held in place by the rigidity of the cartilage. Such an earring may be firmly attached without the necessity of a clasp or the danger of a surgical hole. Further, due to the rigidity of the cartilage, a small earring may be worn without the necessity of a clasp. Due to the construction of the present invention, the tips of metal-coated wire will not be visible and will therefore not require additional coating. Additionally, such an earring can be shaped so as to impart the appearance that the ear in which the earring is being worn is pierced. This is especially true when a small earring according to the present invention is worn.

Accordingly, it is a primary object of the present invention to provide an improved earring.

This and further objects and advantages will be apparent to those skilled in the art in connection with the drawings and the detailed description of the preferred embodiment set forth below.

DETAILED DESCRIPTION OF THE PREFERRED EMBODIMENT

Figure 1:
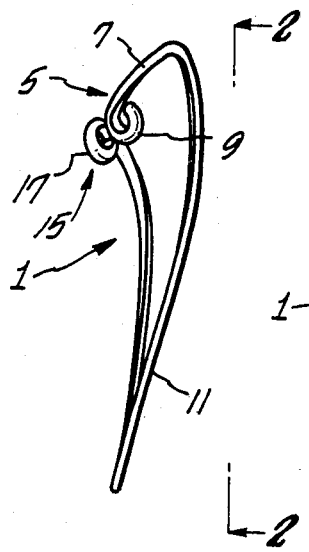
FIG. 1 is side view of an earring for a left ear according to the present invention.

The preferred embodiment of an earring according to the present invention, generally designated as 1, is depicted in FIGS. 1 through 6. The earring is formed generally as an open ended loop having opposed ends. The earring 1 generally comprises a support portion 5, a connecting portion 11 and a grip portion 15. The support portion, generally designated as 5, comprises a curving portion 7 and a support end 9 which will abut the cartilage, generally designated as 27 (FIGS. 3–6), which forms the front portion 21 of the pinna of an ear, generally designated as 25. The support end 9 is curved in order to prevent an edge from rubbing the ear and thereby causing discomfort to the wearer. In a similar manner, the grip end 17 is also curved to prevent discomfort to the wearer. The connecting portion 11 is curved so as to allow the earring 1 to lie adjacent the face of the wearer. The connecting portion 11 also biases the support portion 5 and the grip portion, generally designated as 15, against the cartilage 27 of the ear when the earring 1 is being worn. The connecting portion 11 may be made of a material which may be bent to change the configuration of the connecting portion 11 or adjust the degree to which the earring 1 will lie adjacent to the face of the person wearing the earring 1. Thus, the material can be pliable or the thickness may be such so as to allow the connecting portion 11 to be bent.

Figure 2:
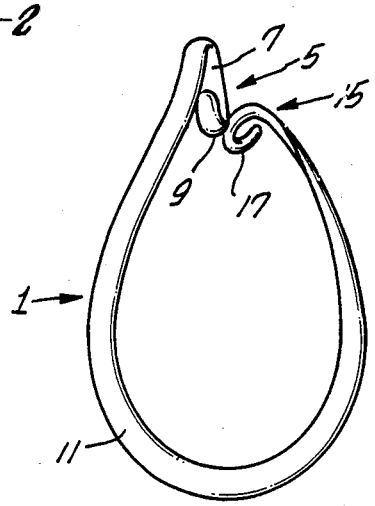
FIG. 2 is a side view of an earring for a left ear according to the present invention.

The earring illustrated in FIGS. 1 and 2 is spatially constructed such that the connecting portion 11 includes at least one segment extending in at least one direction which does not lie in any plane containing both the support portion 5 and the grip portion 15. The connecting portion 11 is comprised of a compound curve substantially describing a first substantially hyperbolic curve in a first plane and a second substantially hyberbolic curve in a second plane, the first substantially hyperbolic curve and the second substantially hyperbolic curve being joined by a third substantially hyperbolic curve in a third plane, the third plane being substantially perpendicular to both the first and the second planes said first plane being substantially perpendicular to the second plane. Also, the support portion inclines downwardly and is in opposed relation to the grip portion. The grip portion and support portion and their adjacent respective connecting portions are disposed in a generally right angle relationship as is illustrated in FIGS. 1 and 2.

An earring 1 according to the present invention may be constructed of a solid material, such as gold, or it may be constructed of a coated wire. When an earring 1 is constructed from a gold-coated wire, for example, the gold-coated wire for each earring 1 may be cut from a reel of such material. However, when such a piece of wire is utilized, the ends where the wire is cut will not be coated. Thus, conventionally, such ends had to be specially coated or a small amount of gold had to be welded to the exposed ends. In either case, an additional step was required which necessarily increased the cost of production. In the present invention, this extra step has been eliminated by curling the support end 9 and the grip end 17 so the exposed uncoated metal will be hidden from view while the comfort of the earring 1 is increased by eliminating any edges which would otherwise come into contact with the ear of a person wearing the earring 1. Thus, when a first length of a coated wire is cut from a reel or second length of coated wire, two uncoated ends of the coated wire will be formed. The ends of the first length of the coated wire will then be curled to form the curled support end 9 and the grip end 17. Since the uncoated ends are pointed toward or abut a coated surface of the first length of coated wire, the uncoated ends will not be visible when the earring 1 is being worn. Thus, the earring 1 comprising the support portion 5, the grip portion 15 and the connecting portion 11 cut from the coated wire would be defined by an elongate element of a unitary construction having a substantially uniform cross section. The connecting portion, as shown in FIGS. 1 and 2, would have three segments which form three curves in three different planes and thus form a three dimensional, U-shape lying in at least three planes.

Figure 3:
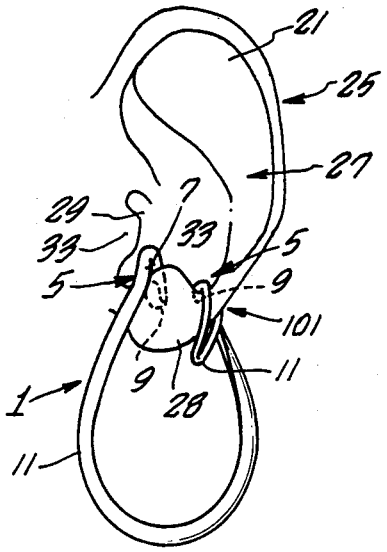
FIG. 3 is a drawing showing a front view of earrings for a left ear according to the present invention being worn.
Figure 4:
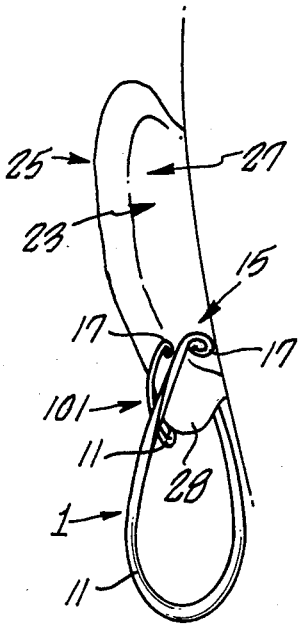
FIG. 4 is a drawing showing a rear view of earrings for a left ear according to the present invention being worn.
Figure 5:
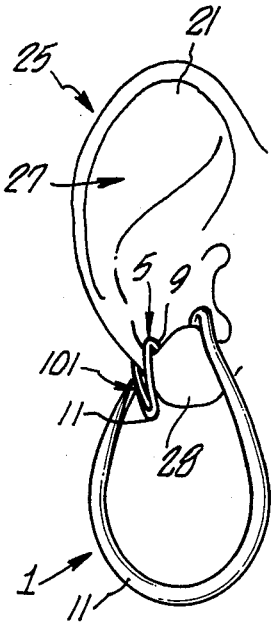
FIG. 5 is a drawing showing a front view of earrings for a right ear according to the present invention being worn.
Figure 6:
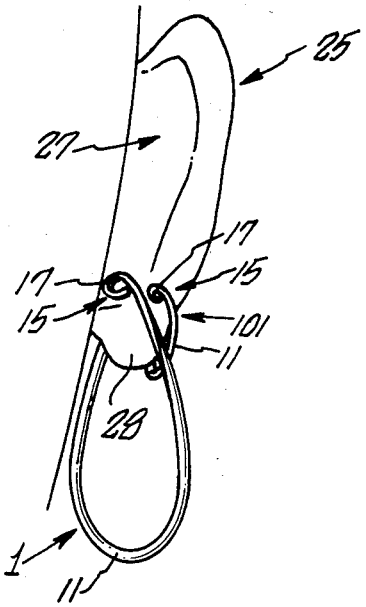
FIG. 6 is a drawing showing a rear view of earrings for a right ear according to the present invention being worn.

The earring 1 of the present invention is designed to be attached to the cartilage 27 of the pinna 25 of the external ear of a person wearing the earring 1. As shown in FIG. 3, the pinna consists of a single piece of cartilage 27, and a lobule 2 which is composed of tough areolar and adipose tissue which is wanting the firmness and elasticity of the reset of the pinna. The cartilage 27 has several fissures, including the concha 29, the anti-helix 31 and the anti-tragus 33, all of which are more fully described in Gray's Anatomy, The Classic Collector's Edition (1977) at pages 848 through 850, the disclosusre of which is hereby specifically incorporated herein by reference. An earring 1 according to the present invention may be attached to several different fissures of the cartilage 27, any of which would provide the necessary rigidity to hold the earring in place.

The invention will be further illustrated by the examples that are illustrated in FIGS. 3 through 6. In a first earring 1, the support portion 5 of the earring 1 abuts the concha 29 on the front side 21 of the pinna 25, the grip portion 15 abuting the back portion 23 of the cartilage 27. The curving mold 7 of the support portion 5 holds the support end 9 underneath the anti-helix 31 of the front portion 21 of the cartilage 27 when the connecting portion 11 biases the support portion 5 and the grip portion 15 toward each other. In a second and smaller earring 101, the earring 101 rests in a fissure in the pinna 25. In this smaller earring 101, the connecting portion 11 rests against the pinna 25 rather than hanging below the lobule 28. However, as illustrated in FIGS. 3 through 6, the earrings 1 and 101 both impart the appearance that the ear in which the earrings 1 and 101 are being worn is pierced. Further, the configuration of the earring, as shown in FIGS. 1 through 6 for earrings 1 and 101, is such that the support portion 5 rests against the cartilage of the pinna of an ear to provide a blunt end within the ear which avoids pointing toward the ear canal.

Having fully described the present invention, it will be apparent from the above description and drawings that various modifications may be made within the scope of the present invention. Thus, the support portion of an earring according to the present invention could be supported by a number of portions and fissures of the cartilage of the pinna. Therefore, the present invention is not intended to be limited except as may be required by the lawful scope of the following claims.

What is claimed is:

1. An earring formed as an open ended loop, comprising:

one end of said loop forming a downwardly inclined support portion adapted to rest against and be supported by cartilage of a front inner portion of an ear;

a grip portion formed on the opposite end of the loop adapted to be positioned so as to abut cartilage of a back portion of an ear; and a connecting portion connecting the support portion and the grip portion, said connecting portion including at least one segment extending in at least one direction which does not lie in any plane containing both said support portion and said grip portion, said support portion and said grip portion and their adjacent respective connecting portions being positioned in opposed and generally right angle relationship.

2. An earring as recited in claim 1 wherein the support portion, the grip portion and the connecting portion are defined by an elongate element.

3. An earring as recited in claim 2 wherein the support portion is constructed to rest on cartilage of a pinna of an ear.

4. An earring as recited in claim 3 wherein the support portion is constructed to rest in the concha of the ear.

5. An earring as recited in claim 4 wherein the support portion is curved to conform to cartilage of the pinna.

6. An earring as recited in claim 2 wherein the configuration of the connecting portion may be altered so as to allow the earring to lie adjacent to the face of a person wearing the earring.

7. An earring as recited in claim 2, wherein the earring imparts the appearance of a pierced earring when the earring is worn in the pinna of the ear.

8. An earring as recited in claim 2 wherein the elongate element is of a unitary construction.

9. An earring as recited in claim 2 wherein the connecting portion has three segments which form three curves in three different planes.

10. An earring as recited in claim 2 wherein the support portion is constructed to rest against cartilage of the front portion of the pinna of the ear at a single contact area.

11. An earring as recited in claim 10 wherein the support portion comprises a curled support end which contacts the ear when the earring is worn.

12. An earring as recited in claim 11 wherein the curled support end does not point toward the ear canal when the earring is worn.

13. An earring as recited in claim 10 wherein the grip portion comprises a curled grip end which contacts the ear when the earring is worn.

14. An earring as recited in claim 2 wherein the earring is formed by bending a wire.

15. An earring as recited in claim 2 wherein the elongate element has a substantially uniform cross section area.

16. An earring as recited in claim 2 wherein the connecting portion has a three dimensional U-shape lying in at least three planes.

17. An earring as recited in claim 16 wherein said elongate element has a substantially uniform cross section.

18. An earring formed as an open ended loop, comprising:

one end of said loop forming a downwardly inclined support portion adapted to rest against and be supported by cartilage of a front inner portion of an ear;

a grip portion formed on the opposite end of the loop adapted to be positioned so as to abut cartilage of a back portion of an ear; and a connecting portion connecting the support portion and the grip portion, said connecting portion having a first segment adjacent to said support portion lying in a first plane and a second segment adjacent to said grip portion lying in a second plane, said first plane and said second plane being substantially perpendicular to one another, wherein said support portion, said grip portion and said connecting portion are defined by an elongate element.

19. An earring as recited in claim 18 wherein said elongate element is of unitary construction.

20. An earring as recited in claim 18 wherein said first segment and said second segment are connected by a third segment which is not confined within the first plane and the second plane.

21. An earring as recited in claim 20 wherein said third segment has a three-dimensional U-shape.

22. An earring formed as an open ended loop, comprising:

one end of said loop forming a downwardly inclined portion adapted to rest against and be supported by cartilage of a front inner portion of an ear;

a grip portion formed on the opposite end of the loop adapted to be positioned so as to abut cartilage of a back portion of an ear; and a connecting portion connecting the support portion and the grip portion, said connecting portion comprising a compound curve substantially describing a first curve in a first plane and a second curve in a second plane, said first plane being substantially perpendicular to the second plane, said first curve and said second curve being joined by a third curve in a third plane, and, said third plane is substantially perpendicular to both the first plane and the second plane.

23. An earring as recited in claim 22 wherein the first curve, the second curve and the third curve are all substantially hyperbolic.

24. An earring as recited in claim 23 wherein the support portion, the grip portion and the connecting portion are defined by an elongate element.

25. An earring as recited in claim 24 wherein the elongate element has a substantially uniform cross section.

* * * * *